US005427276A

United States Patent [19]

Knuettel, II et al.

[11] Patent Number: 5,427,276

[45] Date of Patent: Jun. 27, 1995

[54] MACHINE FOR DISPENSING CHILLED ALCOHOLIC BEVERAGE WITH SELF-CONTAINED COOLING TANK AND BOTTLE MOUNTING SYSTEM

[75] Inventors: Francis P. Knuettel, II, New Rochelle; Mohamad K. Moallemi, Bayside, both of N.Y.

[73] Assignee: Sidney Frank Importing Co., Inc., New Rochelle, N.Y.

[21] Appl. No.: 259,999

[22] Filed: Jun. 15, 1994

[51] Int. Cl.[6] ..... B67D 5/62

[52] U.S. Cl. ..... 222/131; 62/390; 62/394; 62/397; 141/351; 141/364; 222/145.2; 222/146.6; 222/185

[58] Field of Search ..... 222/130, 131, 132, 145, 222/146.1, 146.6, 185; 62/389, 390, 393, 394, 395, 396, 397, 399; 141/351, 364, 366

[56] References Cited

U.S. PATENT DOCUMENTS

| | | | |
|---|---|---|---|
| D. 306,258 | 2/1990 | Liss . | |
| D. 307,709 | 5/1990 | Liss . | |
| 1,749,194 | 3/1930 | Schmitt | 62/397 X |
| 1,946,314 | 2/1934 | Desmond | 141/356 |
| 2,711,268 | 6/1955 | Cannella | 222/145 X |
| 2,774,393 | 12/1956 | Swan | 222/146.6 X |
| 3,060,703 | 10/1962 | Benua et al. | 62/397 X |
| 3,179,292 | 4/1965 | Terry | 222/146.1 X |
| 3,195,779 | 7/1965 | Nicko | 222/131 X |
| 3,250,433 | 5/1966 | Christine et al. | 222/146.6 X |
| 3,416,577 | 12/1968 | Franz | 141/351 X |
| 3,647,118 | 3/1972 | Johnson et al. | 222/145 |
| 3,712,514 | 1/1973 | LeBlanc | 222/146.6 |
| 3,910,461 | 10/1975 | Eager | 222/131 |
| 4,033,483 | 7/1977 | Neidorf | 222/185 X |
| 4,238,053 | 12/1980 | Bonini | 222/146.6 X |
| 4,545,505 | 10/1985 | Mueller et al. | 222/146.6 X |
| 4,699,188 | 10/1987 | Baker et al. | 222/146.6 X |
| 4,742,939 | 5/1988 | Galockin | 222/146.6 X |
| 4,925,068 | 5/1990 | Schneider | 222/484 |
| 4,949,552 | 8/1990 | Adams | 62/399 X |

FOREIGN PATENT DOCUMENTS

| | | | |
|---|---|---|---|
| 1240 | of 1894 | United Kingdom | 62/397 |

*Primary Examiner*—Kevin P. Shaver
*Attorney, Agent, or Firm*—Morgan & Finnegan

[57] ABSTRACT

A machine dispenses viscous, chilled alcoholic beverage and has a housing forming an enclosure with side, top and bottom surfaces. The side, top and bottom surfaces are of such dimension to form a housing of a size to be placed on the countertop of a bar and the like. A refrigeration cooling unit is contained within the enclosure and includes a compressor, condenser and evaporator coil. A beverage faucet is mounted on the side surface of the housing and a manifold is mounted in a top portion of the housing. A cooling tank is mounted at a vertical height above the beverage faucet. Beverage is received from the manifold into the tank. At least a portion of the evaporator coil extends within the tank for cooling alcoholic beverage contained therein. A beverage delivery tube connects between the cooling tank and the beverage faucet for delivering cooled beverage by gravity flow from the cooling tank to the beverage faucet. At least one bottle mount extends from the manifold upward through the housing. Each bottle mount is configured for receiving a stopper shaft of a bottle stopper inserted within a beverage container so that the beverage container may be invertibly mounted on the housing.

18 Claims, 3 Drawing Sheets

MACHINE FOR DISPENSING CHILLED ALCOHOLIC BEVERAGE WITH SELF-CONTAINED COOLING TANK AND BOTTLE MOUNTING SYSTEM

This application is related to copending patent application Ser. No. 08/237,816, filed May 4, 1994, entitled "Machine For Dispensing Chilled Alcoholic Beverage Having Improved Cooling Circuit And Bottle Mounting System," which is hereby incorporated by reference.

FIELD OF THE INVENTION

This invention relates to a machine for dispensing chilled beverage, and more particularly to a machine for dispensing chilled alcoholic beverage which includes a refrigeration cooling unit contained within a housing and beverage containers invertibly mounted on the housing for delivering alcoholic beverage by gravity flow to a beverage faucet mounted on a side surface of the housing.

BACKGROUND OF THE INVENTION

In copending patent application Ser. No. 08/237,816, entitled MACHINE FOR DISPENSING CHILLED ALCOHOLIC BEVERAGE HAVING IMPROVED COOLING CIRCUIT AND BOTTLE MOUNTING SYSTEM, filed May 4, 1994, a machine is disclosed which dispenses specialty alcoholic beverage while cooling the beverage to temperatures below freezing, i.e. about 15 degrees Fahrenheit. The specialty beverage is a viscous liqueur that is periodically withdrawn from bottles while 1) insuring that the bottles are displayed on the housing in an inclined (e.g. slanted or inverted) orientation to allow the viscous liquid to flow therefrom, 2) insuring that the dispensed liqueur is adequately cooled even in times of high usage and dispensing activity, and 3) insuring adequate control when dispensing the viscous beverage. The machine also controls delivery of viscous alcoholic beverages such as a thick liqueur using a small self-contained housing that may be placed on a tabletop of a bar and similar public environment where ornamental bottles are to be displayed.

The machine has a housing forming an enclosure and an outer surface. A refrigeration cooling unit is contained within the housing and includes a compressor, condenser and evaporator coil. A beverage faucet is mounted on the outer surface of the housing. A bottle mount is positioned on the top surface of the housing and mounts at least one inclined, preferably inverted, beverage container thereon. A manifold is mounted in the housing to receive beverage from the inclined beverage container. A beverage delivery tube is contained within the housing and is operatively connected to the beverage faucet and manifold for delivering beverage from containers and manifold to the beverage faucet.

A portion of the beverage delivery tube extends coaxially within the evaporator coil to form a chilled beverage line for chilling any beverage flowing through the beverage delivery tube. The chilled beverage line includes an egress point from which the beverage delivery tube exits from the evaporator coil. The egress point is positioned at a vertical height approximate to the vertical height of the beverage faucet. The chilled beverage line is preferably horizontally oriented and positioned within the top portion of the housing as a looped coil, and is at a vertical height. This facilitates maintenance of the system because the chilled beverage line can then be purged during cleaning and maintenance. The horizontal configuration also helps prevent air pockets from forming. A pump is interposed within the beverage delivery tube and pumps beverage to the beverage faucet. An electrical switch actuates on-off operation of the pump. The bottles are mounted on bottle mounts in an inclined, preferably inverted, orientation on top of the housing.

In this machine, the chilled beverage line must extend a sufficient distance to allow sufficient cooling of a beverage to about fifteen degrees Fahrenheit. It also is horizontally oriented along the top portion of the housing. A pump must also be included within the housing. These components and beverage line configuration take up greater space, requiring a larger housing, and requiring greater tabletop space when the housing is positioned on a bar or other table. The pump also requires energy and generates more heat within the enclosure thus requiring greater cooling energy from the compressor and other components.

It is desirable to use gravity flow of the beverage so that a beverage pump is not required. Additionally, without a coaxially arranged beverage delivery tube placed in the enclosure and requiring long tube lengths for cooling, it would be possible to reduce the amount of required housing enclosure area.

SUMMARY OF THE INVENTION

The present invention provides advantageous features and advantages over other devices by dispensing chilled alcoholic beverage and providing adequate cooling to the beverage, while 1) maintaining a smaller area for placement on tabletops or bartops and 2) using gravity flow of the alcoholic beverage to a beverage faucet positioned on the side of the housing without use of a pump as in the aforementioned disclosure.

In accordance with the present invention, the machine has a housing forming an enclosure with side, top and bottom surfaces. The side, top, and bottom surfaces are dimensioned to form a housing that may be placed on the countertop of a bar or other public area. A refrigeration cooling unit is contained within the enclosure and includes a compressor, condenser and evaporator coil. A beverage faucet is mounted on a side surface of the housing.

A beverage manifold is mounted in the housing at a top portion thereof for receiving beverage. A cooling tank is mounted at a vertical height above the beverage faucet and includes means for receiving beverage from the manifold into the tank. At least a portion of the evaporator coil extends within the tank in a coil arrangement therein for cooling viscous alcoholic beverage contained therein. The cooling tank is connected to the beverage faucet and delivers cooled beverage by gravity flow from the cooling tank to the faucet. At least one bottle mount extends from the manifold upward through the housing. Each bottle mount is configured for receiving a stopper shaft of a bottle stopper inserted within a beverage container so that the beverage container may be invertibly mounted on the housing to supply beverage to the cooling tank.

In one aspect of the invention, the cooling tank and evaporator coil are mounted on the side of the housing adjacent to the beverage faucet. An insulating wall is mounted within the housing and extends substantially from side to side and top to bottom, and separates the cooling tank and evaporator coil therein from the condenser and compressor. In another aspect of the invention, the manifold extends through the insulating wall so that a portion of the manifold extends on either side of the insulating wall. A plurality of bottle mounts extend from the manifold upward through the housing to form a straight line so that the beverage containers are invertibly mounted linearly across the top of the housing. The manifold may be formed as a tube.

In still another aspect of the invention, the machine includes an air valve and check valve which are operatively connected within the manifold line for permitting air flow therethrough. The air valve is removably mounted to the housing to allow removal and cleaning of the air valve while the check valve prevents inadvertent contamination when the air valve is removed. The bottle mount extends from the manifold upward through the housing and each bottle mount is configured for receiving a stopper shaft of a bottle stopper inserted within a beverage container so that the beverage container may be invertibly mounted on the housing to supply beverage to the cooling tank. The bottle stopper is formed of a hollow shaft with two opposing ends. One end is adapted to extend into the neck of a container. The other end has a side opening and a collar mounted on the shaft. The collar is movable on the shaft from a closed position where the collar covers the opening to prevent beverage withdrawal and an open position where the collar uncovers the opening to allow beverage withdrawal when that end is inserted within the bottle mount.

The collar includes a tapered portion that engages a corresponding tapered portion of the bottle mount. The shaft includes O-rings for sealing between the collar and the shaft to prevent leakage in the closed position. One O-ring is positioned above the side opening of the shaft, and one O-ring is positioned below the side opening of the shaft. The cooling tank and evaporator coil are mounted on the side of the housing adjacent to the beverage faucet. An insulating wall is mounted within the housing and extends substantially from side-to-side and top-to-bottom and separates the cooling tank and evaporator coil from the condenser and the compressor.

BRIEF DESCRIPTION OF THE DRAWINGS

The advantages of the present invention will be appreciated more fully from the following description, with reference to the accompanying drawings in which.

DETAILED DESCRIPTION OF THE INVENTION

Figure 1:
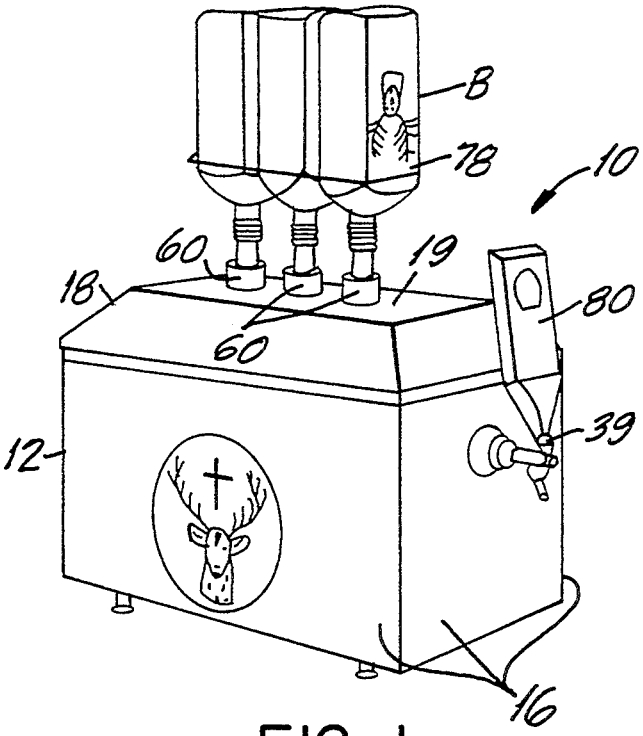
FIG. 1 is an environmental view of the machine of the present invention which dispenses chilled and viscous alcoholic beverage.

Referring now to FIG. 1, there is illustrated at 10 an environmental view of the machine for dispensing chilled alcoholic beverages in accordance with the present invention. As illustrated in greater detail in FIG. 2, the machine 10 includes a generally rectangular configured housing indicated generally at 12, that forms an enclosure 14 and has a outer surface with sidewalls 16, a bottom surface 17, and a top surface 18, which has upwardly inclined walls converging to a flat top 19. The side 16, bottom 17, and top 18 surfaces are of preferred dimension that the machine 10 may be placed on the countertop of a bar (not shown), table or other similar structure. Leg supports **19*a*** can be secured on the bottom surface.

Figure 2:
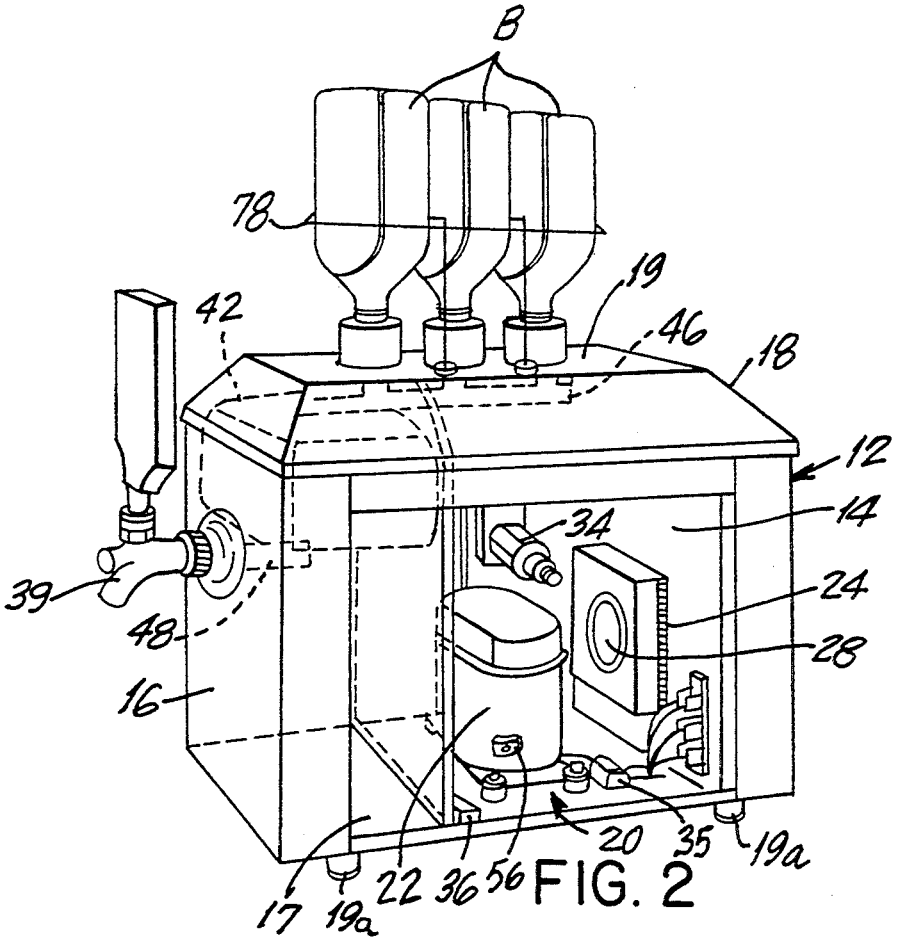
FIG. 2 is an isometric view of the machine of the present invention and showing internal parts of the machine.
Figure 6:
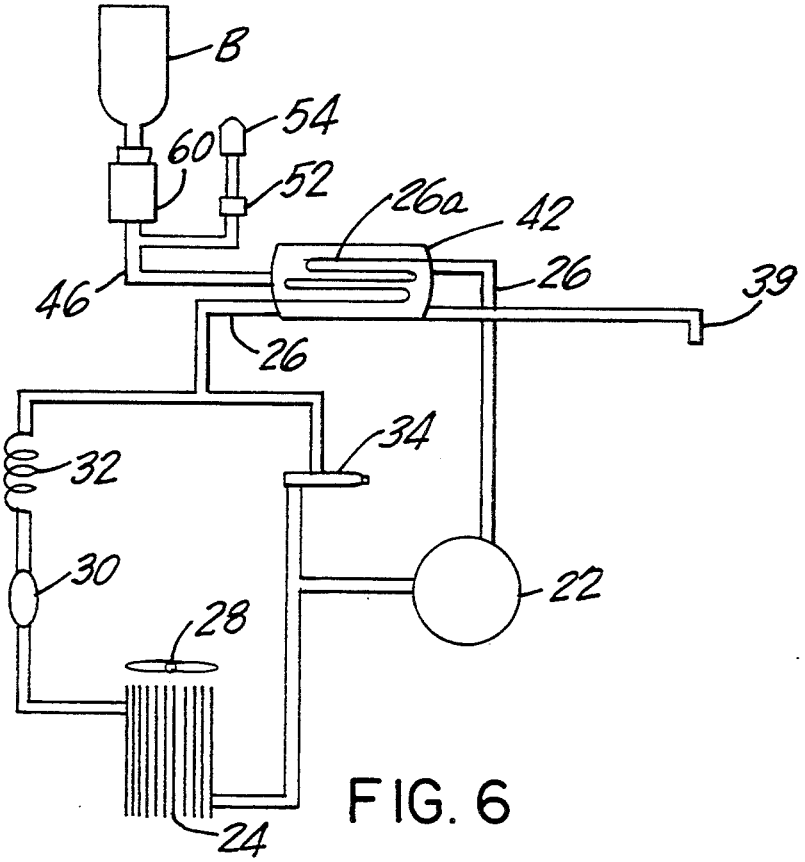
FIG. 6 is a schematic drawing of the cooling circuit.

As shown in FIG. 2, and in the schematic of FIG. 6, the machine 10 includes a refrigeration cooling unit, indicated generally at 20 contained within the housing 12. The refrigeration cooling unit 20 includes a compressor 22, condenser 24, evaporator coil 26, as well as a throttling device (not shown in detail), which together form a closed refrigeration circuit. The refrigeration cooling unit uses a conventional refrigerant liquid which expands to form a gas and condenses back to a liquid.

The compressor 22 compresses the low pressure gas to a high pressure gas and pumps the high pressure gas to the condenser 24. The condenser 24 converts the high pressure gas to high pressure liquid by extraction of heat from the gas. Heat is transferred to air passing over the condenser coil. A fan 28 forces air over the condenser to aid in cooling. A drier/strainer 30 traps any residual moisture or contaminants in the system. The capillary tube 32 is a device to control flow of high pressure liquid entering the evaporator.

The evaporator coil 26 provides a low pressure chamber for the liquid refrigerant to evaporate. The evaporator absorbs heat from all surfaces within the evaporator including the tube containing the beverage. The hot gas valve 34 responds to evaporator pressure and bypasses the hot gas to the evaporator if the evaporator pressure is too low. The evaporator is designed for continuous operation at −10° F. The refrigeration cooling unit 20 also includes a start relay and overload protector 35 and refrigeration switch 36 as is common to these types of units. The start relay and overload protector 35 can be mounted on the compressor 22, or on the floor formed by the bottom surface as illustrated. In more confined spaces, such as with the present invention, the protector 35 may be mounted off the compressor 22 as illustrated.

In accordance with the present invention, a beverage faucet 39 is mounted on a side wall 16 of the housing and the beverage is dispensed therethrough. Inverted beverage containers, i.e. bottles B, are mounted on top of the housing. In the present illustrated embodiment, the beverage containers are shown as beverage bottles containing a high viscosity alcoholic beverage such as a liqueur commercially sold under the Tradename Jagermeister. Although three inverted bottles B are illustrated, a different number of bottles may be mounted depending on the size of the bottles. Typically, with bottles having a capacity of about a quart or liter, three linearly arranged bottles is sufficient relative to the size of the desired housing as illustrated in FIGS. 1 and 2. The size machine 10 gives a pleasant, aesthetic look when the machine is placed on a bar. Some other arrangement besides a linear arrangement of the bottles could also be used.

Figure 5:
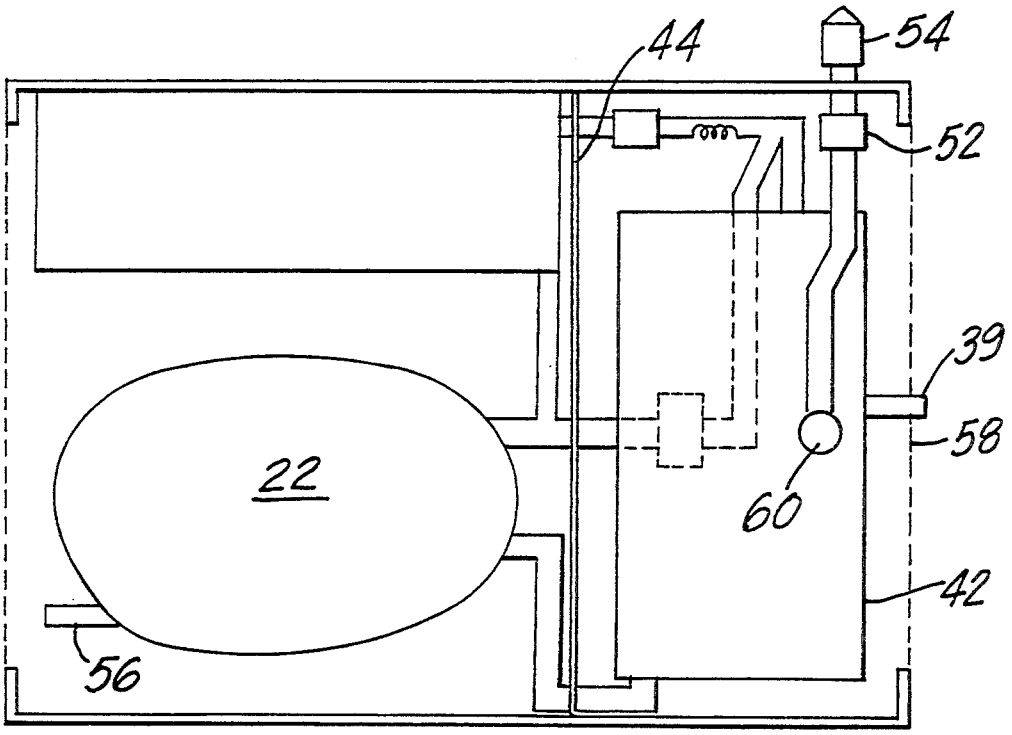
FIG. 5 is a schematic plan view of the machine of the present invention.

As shown in FIGS. 2 and 5, a cooling tank 42 is mounted at a vertical height above the beverage faucet 39 towards the front of the machine 10 adjacent to the beverage faucet. The cooling tank is separated from the compressor 22, fan 28, condensor 24 and other associated refrigeration components by an insulating wall 44. The insulating wall provides the insulation necessary to prevent heat generated from the compressor and other from heating the cooling tank 42. The cooling tank 42 holds typically about 23 to 25 ounces of liqueur.

A manifold 46 extends along the top of the housing and receives the liqueur from the beverage bottles as shown in FIG. 2. A portion of the manifold 46 extends through the insulating wall 44. The manifold 46 then connects into the top of the cooling tank 42. An outlet 47 at the bottom of the cooling tank 42 extends into a second manifold 48 which leads to the beverage faucet 39 so that any liqueur of beverage contained within the cooling tank 42 will flow by gravity outward through the beverage faucet 39.

As shown in FIG. 6 and FIG. 2, the evaporator line 26 extends through the insulating wall 44 into a coil arrangement in the cooling tank. The evaporator coil 26*a* draws heat from the liqueur contained within the cooling tank 42, thus cooling the beverage (liqueur) contained within the cooling tank. This is advantageous because the unit is small, and during peak activity times, the beverage will be dispensed quickly and the insulating wall allows adequate cooling which is essential.

A check valve 52 and air valve 54 are connected into the manifold 46 and extend outward through the side 16 of the housing. Because beverage flow is by gravity, the air valve 54 allows gravity flow of liqueur from the cooling tank 42 and bottles into the cooling tank. The air valve may become dirty in use, and it is removable from the check valve 52, which provides a safety valve when the air valve is removed and cleaned. A compressor recharge valve 56 is positioned on the compressor 22, and in one aspect of the invention is accessible through an access panel 58 (FIG. 5) so that the compressor can be recharged when necessary.

Figure 3A:
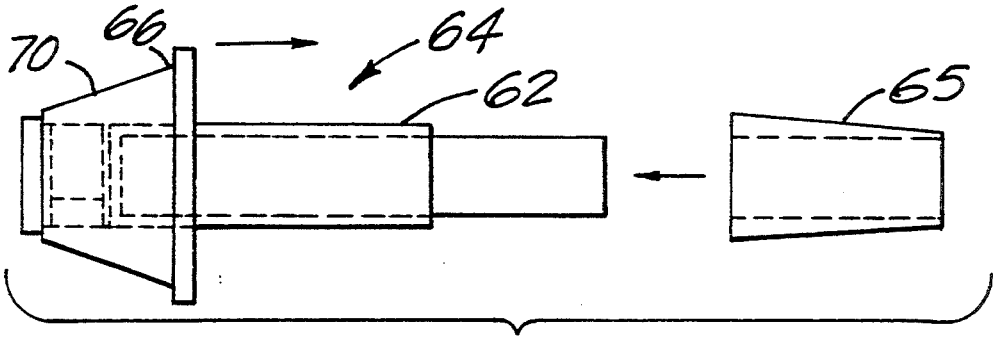
FIG. 3A PRIOR ART
FIGS. 3A and 3B are plan view of the stopper shaft used in accordance with the present invention.

Referring now to FIGS. 3 and 4, there is illustrated in greater detail the mounting mechanism used for mounting the inverted bottles B onto the housing. As shown in FIG. 2, the beverage manifold 46 is mounted within the housing adjacent to the top portion thereof. The manifold 46 is connected to the cooling tank 42 and delivers beverage to the tank.

A bottle mount 60 extends from the manifold 46 upward through the housing 12. Each bottle mount is configured for receiving a stopper shaft 62 of a bottle stopper, indicated generally at 64, which is inserted within a bottle B as shown in FIGS. 4A–4C.

Figure 3B:
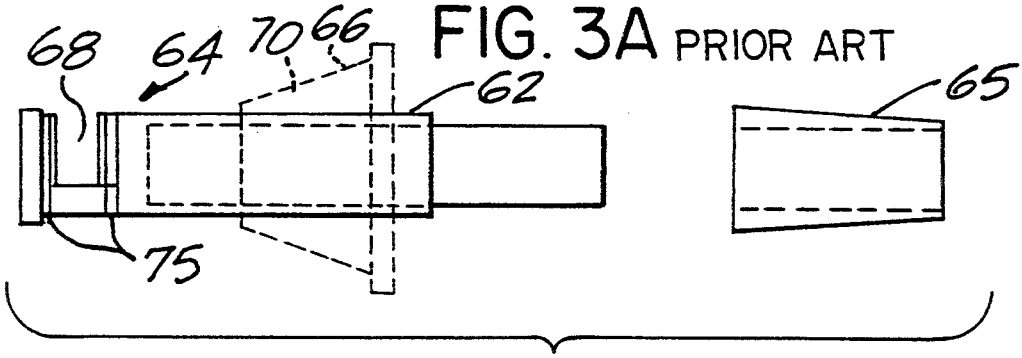
FIG. 3B PRIOR ART

As shown in FIGS. 3 and 3B, the bottle stopper 64 is formed as a hollow shaft and includes a slidable collar 66 positioned on a medial portion of the stopper shaft 62. One end of the bottle stopper 64 is adapted for insertion into the neck of the bottle B and includes a tapered plug 65 which frictionally fits into the bottle opening. The other end has a side opening 68 (FIGS. 3B and 4C). The slidable collar 66 has a tapered portion 70 that engages a corresponding tapered portion 72 of the bottle mount. The collar 66 is movable on the stopper shaft from a closed position where the collar 66 covers the side opening 68 to prevent beverage withdrawal to an open 68 position where the collar uncovers the side opening to allow beverage withdrawal when that end is inserted within the bottle mount.

Figure 4A:
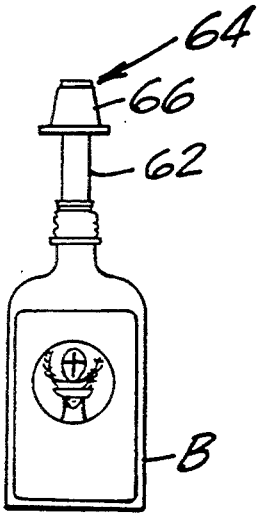
FIGS. 4A–4C show the stopper shaft used with the beverage bottles and supported on the bottle mounts of the machine housing.
Figure 4B:
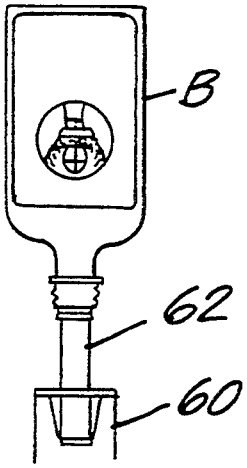
Figure 4C:
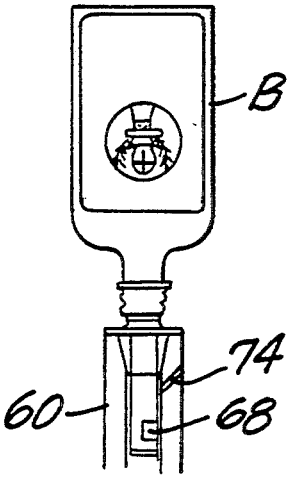

As shown in FIGS. 4A–4C, the collar 66 is moveable relative to the stopper shaft 62. When the stopper shaft 62 is inserted within a bottle mount 60, the bottle B is forced downward so that the side opening 68 becomes exposed. A vent hole 74 vents air to facilitate beverage withdrawal from the bottle B (FIG. 4C). An O-ring 75 is positioned above and below the side opening 68 to seal in a closed position.

The use of the bottle mounts 60 and beverage manifold 46 allows ready withdrawal of one bottle, without the necessity of replacing the other bottles. Also an adequate flow of beverage is maintained through the faucet. To ensure that the bottles B remain steady on top the housing, a bottle support cage 78 also supports the bottles.

As shown now in FIGS. 1 and 2, the beverage faucet 39 includes a handle 80 which opens a valve in the outlet when the handle is pulled forward to allow beverage dispensing through the beverage faucet 39.

In operation the bottle stopper 64 is initially placed into the bottle opening at the bottleneck so that the stopper shaft 62 is forced into a friction fit with the bottle opening. The collar 66 and other end of the shaft are then inserted within the bottle mount on the housing. The bottle is pushed downward so that the shaft extends into the neck of the bottle mount. The vent hole 74 allows air entry so that beverage will dispense into the manifold.

The cooled beverage within the cooling tank is dispensed when the handle is pulled forward, opening a valve (not shown) and allowing beverage flow through the beverage faucet 39. The air valve/check valve combination 52, 54 allows air within the manifold line and provides the necessary pressure for beverage dispensing.

The machine in accordance with the present invention has numerous benefits. The insulating wall 44 positioned between the cooling tank 42 and the compressor 22 and other related refrigerating components is beneficial for this type of table top unit where adequate beverage cooling and adequate compressor capacity are necessary to refrigerate a rapidly dispensed liqueur which may have to be cooled to as low as 15° F. During rapid beverage delivery, the compressor gives off heat which can create problems if the insulating wall were not present. The configuration of the bottle mounts, inclined or inverted bottles, manifold 46 and cooling tank 42 allows adequate withdrawal at relatively rapid rates even when the liqueur is cooled to a thick consistency.

Additionally, the stainless steel cooling tank and other stainless steel fittings which are used in the present system are inexpensive to construct and more reliable with the elimination of many other electrical switches and pumps as well as other fittings such as used in other prior art devices. The use of a cooling tank 42 allows a greater amount of cooled product. The elimination of a beverage pump and switch provides quieter operation. The thermal-insulating wall between the compressor and cooling tank yields a more efficient system.

It should be understood that the foregoing description of the invention is intended merely to be illustrative thereof, and that other embodiments, modifications, and equivalents may be apparent to those skilled in the art without departing from its spirit.

That which is claimed is:

1. A machine for dispensing chilled alcoholic beverage comprising a housing forming an enclosure and having side, top, and bottom surfaces, said side and top surfaces being of such dimension to form a housing of a size to be placed on the countertop of a bar, a refrigeration cooling unit contained within said enclosure, said refrigeration cooling unit including a compressor, condenser and evaporator coil, a beverage faucet mounted on a side surface of said housing, manifold means mounted in said housing at a top portion thereof for receiving beverage, a cooling tank mounted at a vertical height above said beverage faucet and including means for receiving beverage from said manifold means into said tank, at least a portion of said evaporator coil extending within said tank for cooling alcoholic beverage contained therein, means connected between said cooling tank and said beverage faucet for delivering cooled beverage by gravity flow from said cooling tank to said beverage faucet, and at least one bottle mount extending from said manifold means upward through said housing, each bottle mount being configured for receiving a stopper shaft of a bottle stopper inserted within a beverage container so that the beverage container may be invertibly mounted on the housing to supply beverage to said cooling tank.

2. The machine according to claim 1 wherein said cooling tank and said evaporator coil therein are mounted on the side of said housing adjacent said beverage faucet, and including an insulating wall mounted within said housing and extending substantially from side-to-side and top-to-bottom and separating said cooling tank and evaporator coil therein from said condenser and compressor.

3. The machine according to claim 2 wherein said manifold means extend through said insulating wall, so that a portion of said manifold means extends on either side of said insulating wall, and including a plurality of said bottle mounts extending from said manifold means upward through said housing in a substantially linear manner so that beverage containers are invertibly mounted linearly across the top of said housing.

4. The machine according to claim 1 including an air valve and check valve operatively connected to said cooling tank for permitting airflow therethrough, and including means removably mounting said air valve to said housing to allow removal and cleaning of said air valve, wherein said check valve prevents inadvertent contamination when said air valve is removed.

5. The machine according to claim 1 wherein said cooling tank is mounted below said manifold to aid in receiving beverage from said manifold by gravity.

6. A machine for dispensing chilled alcoholic beverage comprising a housing forming an enclosure and having side, top, and bottom surfaces, said side and top surfaces being of a dimension to form a housing of a size to be placed on the countertop of a bar, a refrigeration cooling unit contained within said enclosure, said refrigeration cooling unit including a compressor, condenser and evaporator coil, a beverage faucet mounted on a side surface of said housing, manifold means mounted in said housing at a top portion thereof for receiving beverage, a cooling tank mounted at a vertical height above said beverage faucet, said manifold means communicating with said cooling tank for delivering beverage thereto, wherein at least a portion of said evaporator coil extends within said tank in a coiled configuration for cooling alcoholic beverage contained therein, means connected between said cooling tank and said beverage faucet for delivering cooled beverage by gravity flow from said cooling tank to said beverage faucet, and at least one bottle mount extending from said manifold means upward through said housing, each bottle mount being configured for receiving a stopper shaft of a bottle stopper inserted within a beverage container so that the beverage container may be invertibly mounted on the housing to supply beverage to said cooling tank, wherein said bottle stopper is formed of a hollow shaft with two opposing ends, one end having means adapted to extend into the neck of the container, and the other end having a side opening, and a collar mounted on the shaft, said collar being movable on said shaft from a closed position where the collar covers the opening to prevent beverage withdrawal and an open position where the collar uncovers the opening to allow beverage withdrawal when that end is inserted within the bottle mount.

7. The machine according to claim 6 wherein said cooling tank is mounted below said manifold for receiving beverage from said manifold by gravity.

8. The machine according to claim 6 wherein said collar includes a tapered portion that engages a corresponding tapered portion of said bottle mount.

9. The machine according to claim 8 wherein said shaft includes an O-ring for sealing between said collar and said shaft to prevent leakage in the closed position.

10. The machine according to claim 9 wherein at least one O-ring is positioned above and at least one O-ring is positioned below the side opening of said shaft.

11. The machine according to claim 6 wherein said cooling tank and said evaporator coil therein are mounted on the side of said housing adjacent said beverage faucet, and including an insulating wall mounted within said housing and extending substantially from side-to-side and top-to-bottom and separating said cooling tank and evaporator coil therein from said condenser and compressor.

12. The machine according to claim 11 wherein said manifold means extends in said housing so that a portion of said manifold means extends on either side of said insulating wall, and including a plurality of said bottle mounts extending from said manifold means upward through said housing in a substantially linear manner so that beverage containers are invertibly mounted linearly across the top of said housing.

13. The machine according to claim 6 including an air valve and check valve operatively connected to said cooling tank for permitting airflow therethrough, and including means removably mounting said air valve to said housing for cleaning said air valve, wherein said check valve prevents inadvertent contamination when said air valve is removed.

14. A machine for dispensing chilled alcoholic beverage comprising a housing forming an enclosure and having side, top, and bottom surfaces, said side and top surfaces being of such dimension to form a housing of a size to be placed on the countertop of a bar, a refrigeration cooling unit contained within said enclosure, said refrigeration cooling unit including a compressor, condenser and evaporator coil, a beverage faucet mounted on a side surface of said housing, means for invertibly mounting at least one beverage container on top of said housing, a cooling tank mounted in said enclosure at an upper portion thereof adjacent said top surface, and at a vertical height above said beverage faucet, at least a portion of said evaporator coil extending within said tank for cooling alcoholic beverage contained therein, manifold means positioned at an upper portion of said housing and connecting between said beverage container mounting means and cooling tank for delivering beverage by gravity from an inverted container to the cooling tank, means connected between said cooling tank and said beverage faucet for delivering cooled beverage by gravity flow from said cooling tank to said faucet, and wherein said cooling tank and said evaporator coil therein are mounted on the side of the housing adjacent the beverage faucet, and including an insulating wall mounted within said housing and extending substantially from side-to-side and top-to-bottom and separating the cooling tank and evaporator coil therein from said condenser and compressor.

15. The machine according to claim 14 wherein said manifold means extends on either side of said insulating wall.

16. The machine according to claim 15 wherein said means for mounting includes at least one bottle mount configured for receiving a stopper shaft of a bottle stopper inserted within said beverage container so that the beverage container may be invertibly mounted on the housing to supply beverage to the cooling tank, said bottle mount being operatively connected to said manifold means for delivering beverage thereto by gravity from the inverted container.

17. The machine according to claim 14 wherein said manifold means extends through said insulating wall so that a portion of said manifold means extend on either side of said insulating wall, and including a plurality of said means for mounting extending from said manifold means upward through said housing to form a straight line so that beverage containers may be invertibly mounted linearly across the top of said housing.

18. The machine according to claim 14 including an air valve and check valve operative connected to said cooling tank to permit airflow therethrough and including means removably mounting said air valve to said housing for cleaning said air valve, wherein said check valve prevents inadvertent contamination when said air valve is removed.

* * * * *